United States Patent [19]

Van Drie

[11] 4,309,141

[45] Jan. 5, 1982

[54] REFUSE-EXTRUDER-AND-COMPACTOR APPARATUS

[76] Inventor: Gerhardt Van Drie, 724 W. Pine Ave., El Segundo, Calif. 90245

[21] Appl. No.: 103,510

[22] Filed: Dec. 14, 1979

[51] Int. Cl.[3] ..... B65F 3/28

[52] U.S. Cl. ..... 414/509; 414/513

[58] Field of Search ..... 414/509–517, 414/525 R; 100/288

[56] References Cited

U.S. PATENT DOCUMENTS

| | | | |
|---|---|---|---|
| 3,212,657 | 10/1965 | Murfitt et al. | 414/512 |
| 3,220,586 | 11/1965 | Gollnick | 414/525 X |
| 3,777,915 | 12/1973 | Reed | 414/509 X |

FOREIGN PATENT DOCUMENTS

| | | | |
|---|---|---|---|
| 1149301 | 5/1963 | Fed. Rep. of Germany | 414/509 |

*Primary Examiner*—Robert G. Sheridan
*Attorney, Agent, or Firm*—Francis X. Lo Jacono

[57] ABSTRACT

An improved refuse-extruder-and-compactor apparatus adapted for general use in the transporting and transferring of solid-waste materials in combination with a refuse-transport vehicle, the apparatus being positioned within the storage container of the vehicle so as to provide a more compact load as well as a means for effectively discharging a load therefrom. The apparatus comprises a vertically disposed blade which includes a linearly arranged guide system to keep the blade in a vertically balanced load situation. The blade is moved by a combination chain-sprocket-drive system coupled to the guide system, said guide system including a rack mechanism whereby the blade is reciprocally moved within the storage container for either compacting or discharging the load therein.

4 Claims, 7 Drawing Figures

REFUSE-EXTRUDER-AND-COMPACTOR APPARATUS

BACKGROUND OF THE INVENTION

1. Field of the Invention

The invention relates generally to the loading and unloading of solid-waste materials, and more particularly to an apparatus for extruding and compacting the material loaded within a refuse-transporting vehicle.

2. Description of the Prior Art

As is well known in the art, various problems and difficulties are encountered in providing suitable means for loading waste materials in a compact form into a refuse-pick-up vehicle or the like. There are also problems in providing a suitable means for discharging the materials stored in such a compact manner, particularly where the material is compacted in trailer-cargo containers having from forty to fifty feet in length.

Due to the ever-growing requirements created by environmental restrictions, the necessity for clean, sanitary, economical and efficient refuse-disposal methods is becoming increasingly critical in larger metropolitan areas. Thus, as the population increases in any given urban area, increasingly larger quantities of refuse are collected. Therefore, trash trucks and other waste-material-collection vehicles must be provided with means to increase their loads efficiently by new compacting arrangements; and they must also be capable of discharging their loads in an efficient, complete and simple manner.

Various types of vehicles and their associated apparatuses, including trash-transfer stations, have been and are still being used. However, these vehicles and their related devices have features that either limit their use or make them obsolete due to the large increase in waste materials.

As examples of several types of known transfer and compacting apparatuses, there are disclosed the following U.S. Patents:

U.S. Pat. No. 3,059,789 is a movable blade that operates by means of a cable and a hydraulically actuated winch.

U.S. Pat. No. 3,129,657 discloses a pusher plate actuated by a cross parallel arm assembly operably connected to a cylinder-piston unit, which is a typical operational device.

In U.S. Pat. No. 3,443,702 there is illustrated a pusher plate which is directly connected by a hydraulic cylinder 36.

The arrangements as disclosed in the above latter two patents limit the vehicle storage container in that it is restricted in the length of the cylinder stroke.

Thus, from the following disclosure it will be apparent that the present invention is capable of efficiently operating within a cargo container of fifty feet and over in length, with a thrust force heretofore not possible with other actuating devices.

SUMMARY AND OBJECTS OF THE INVENTION

Accordingly, the present invention has for an important object to provide an improved means for economically and effectively transferring—in a compacted state—waste material from one vehicle to another vehicle, as well as to discharge the waste material from any length cargo-storage container.

The apparatus comprises a pusher plate or blade that is linearly movable along the entire length of a storage container, the drive mechanism being carried by the blade as it reciprocates linearly therein in a substantially true vertical position.

It is a further object of the invention to provide and incorporate a drive mechanism that applies a thrust force that is continuous throughout its longitudinal travel within the storage container, whereby the force is applied at the central area of the blade in a horizontal plane.

A further object of the present invention is to provide a drive mechanism that includes a hydraulic motor, rather than a hydraulic cylinder, the motor having a dual-rotation power so as to move the blade forwardly and backwardly—the motor driving a two-chain-and-sprocket system which provides a decrease in revolutions and an increase in torque.

It is still another object of the invention to provide an apparatus of this character wherein the drive mechanism will allow a 10,000 pounds pull on the drive to establish a thrust of 30,000 pounds to the blade.

It is another object of the invention to provide an apparatus of this type wherein the application of the linear forces is directed at approximately mid-height of the blade, whereby a more balanced and efficient load situation is realized so that forces are evenly applied to the engaging load of refuse.

The present invention further includes a jam-free, rack-and-pinion system that overcomes the tendency to clog.

It is a further object of the invention to provide a refuse-extruder-and-compactor apparatus of this character that establishes a rapid, clean and effective method of transferring refuse from one vehicle to another, and to further store the material in a compacted condition.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
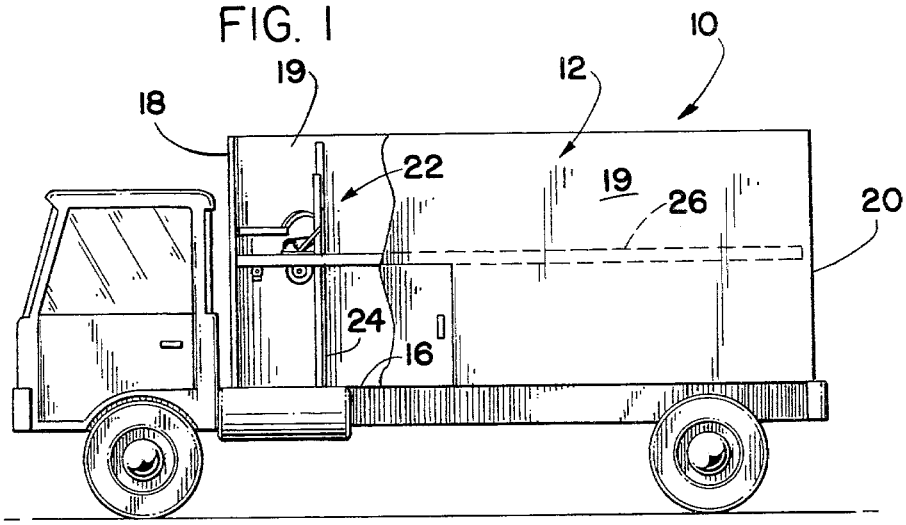
FIG. 1 is a side-elevational view of a refuse vehicle having a portion of the side wall thereof broken away to illustrate the location of the present invention.
Figure 2:
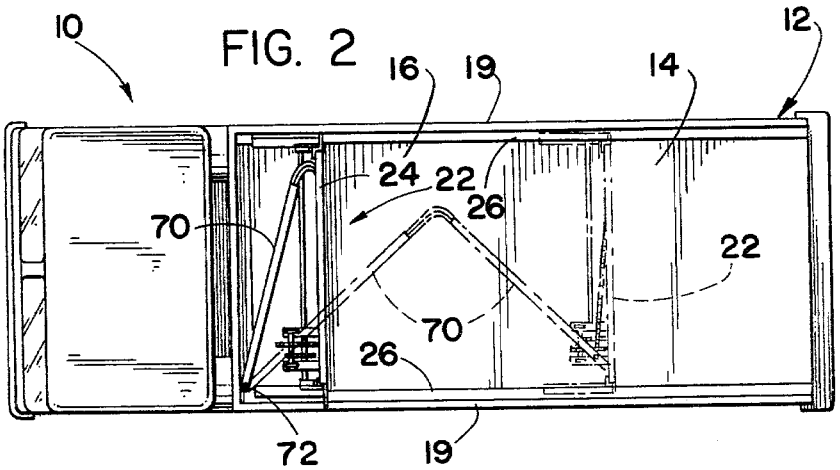
FIG. 2 is a top-plan view of the vehicle with the apparatus shown in the cargo container.
Figure 3:
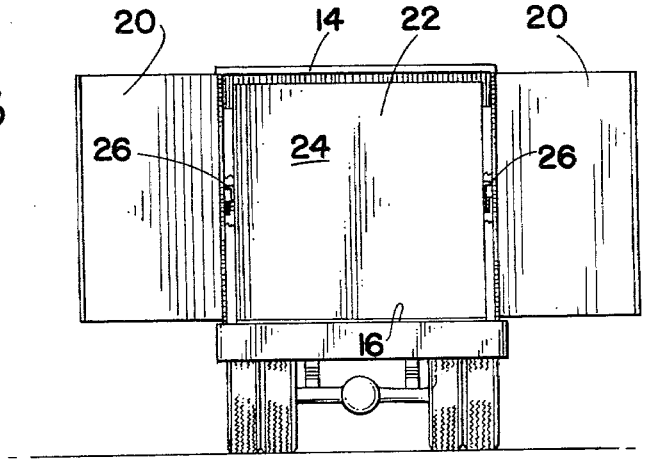
FIG. 3 is a rear-elevational view of the blade mechanism as seen with the rear doors in an open position.

Referring more particularly to FIGS. 1, 2 and 3, there is shown a refuse truck, generally indicated at 10. The particular arrangement of truck 10 is shown as an example only, since the present invention is adapted to be associated with any one of the many known types of waste-collection vehicles.

Truck 10 comprises a cargo container 12 defined by a bottom wall or bed 16, front wall 18, side walls 19, and a rear-door assembly 20 through which truck 10 is loaded or unloaded, the top of said cargo container being open throughout its length.

Operably positioned within the cargo container 12 is a refuse-extruder-and-compactor apparatus, indicated generally at 22, which is normally positioned adjacent the front wall 18. However, the apparatus is designed to reciprocate throughout the full length of the cargo body. Thus, from the following detailed description, it will be readily understood that the present apparatus can be employed in association with cargo bodies having lengths of fifty feet or more.

Figure 4:
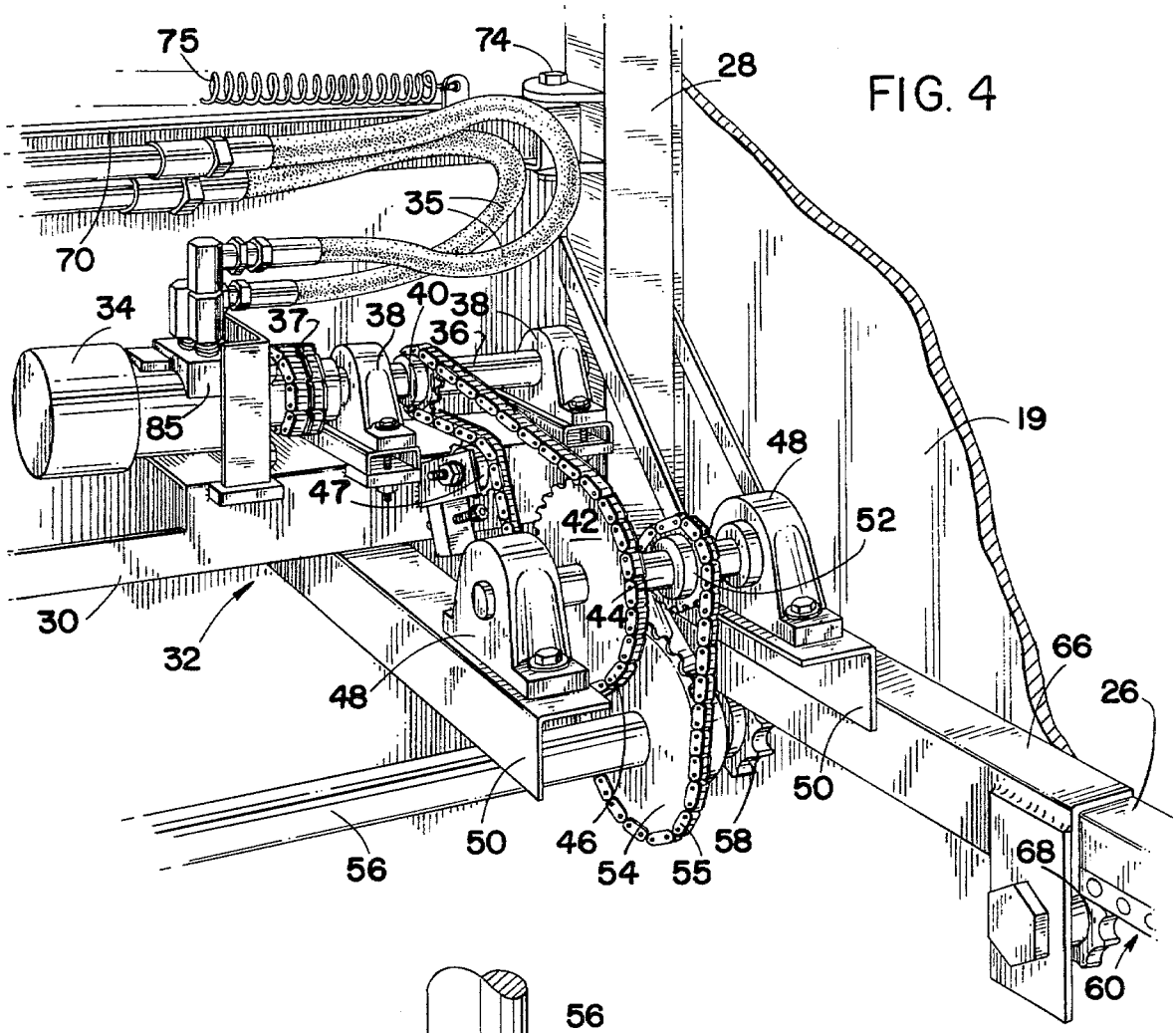
FIG. 4 is an enlarged pictorial view of the drive mechanism as it is mounted to the blade.
Figure 5:
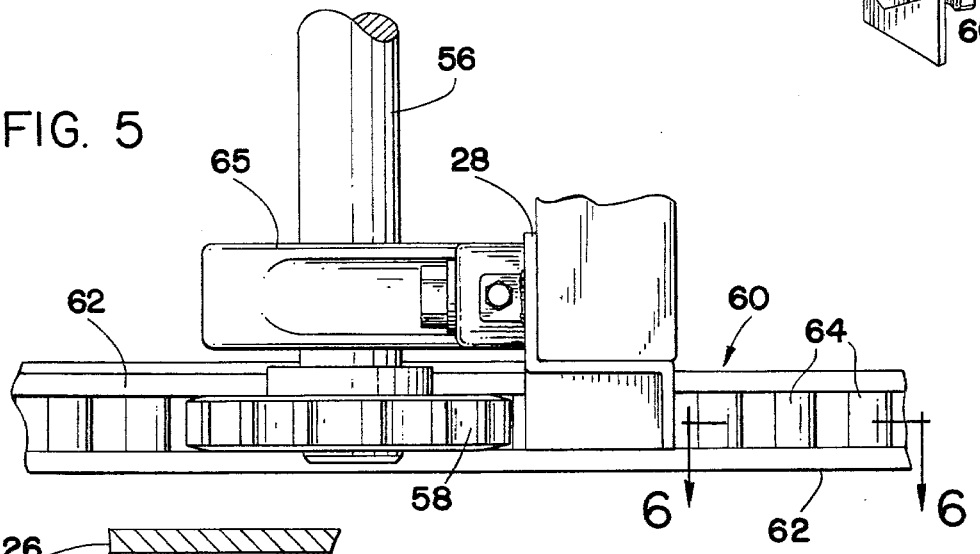
FIG. 5 is a bottom-plan view of the sprocket-and-rack arrangement.
Figure 6:
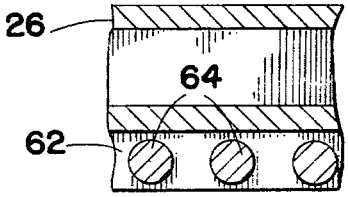
FIG. 6 is a cross-sectional view of the rack taken substantially on line 6—6 of FIG. 5.

To provide for linear movement of the blade, there is included a means for moving the blade along the track, said means being mounted to the blade assembly as seen in FIG. 4. The blade assembly comprises a frame structure, a part of which is indicated at 28. Secured to frame structure 28 is a drive-mounting bracket 30 which is located so as to support drive means 32, said drive means being illustrated as a hydraulic motor 34 with dual rotation. It is contemplated that, when said apparatus 20 is used with a stationary container rather than a vehicle, an electric motor can be used in place thereof.

Hydraulic motor 34 is provided with power hoses 35 for inlet and outlet hydraulic pressure which are connected to well-known hydraulic-pressure systems associated with such vehicles. Motor 34 is shown in FIG. 4 as being mounted to bracket 30, motor 34 having shaft 36 connected thereto by coupling means 37 and supported by aligned bearings 38, the bearings also being supported by bracket 30. Shaft 36 includes a small-diameter drive sprocket 40 which drives a larger sprocket 42 affixed to a second shaft 44, sprocket 42 being operatively connected to sprocket 40 by chain drive 46. There is also included therein an idler sprocket 47. Shaft 44 is journalled in aligned bearings 48 supported by bracket arms 50 affixed to the blade assembly, whereby the drive means is carried to the blade assembly so as to travel longitudinally therewith along rails 26.

A third sprocket 52 is positioned on shaft 44; and it is aligned and connected to a fourth sprocket 54 by chain belt 55—sprocket 54 being affixed to a third shaft 56. Shaft 56 extends transversely between the opposing rails 26, the shaft being provided at its free ends with drive pinion 58 which operably engages each rack means 60. The racks are located longitudinally along the bottom of each rail 26; and they comprise side members 62 with spaced-apart dowel members 64. The arrangement and position of the racks 60 and their dowel members 64 prevent any waste material from becoming lodged therein, as is experienced with well known toothed, gear-type, rock-and-pinion mechanisms. Shaft 36 is journalled in bearings 65, the bearing being mounted to the blade frame assembly 28. Accordingly, as power is supplied to motor 34, the gear-train drive connected thereto is operated to drive rack pinion 58. Thus, a linear movement is established, the blade assembly and the drive means moving longitudinally along the full length of the rails 26.

However, in order to prevent binding or unequal forces from being applied during compacting or extruding of the waste material, the frame assembly 28 further includes a guide means comprising a guide-arm member 66 which extends outwardly from said frame assembly and rests on each rail 26 (See FIG. 4.). Affixed to the outer free end of guide arm 66 is a guide sprocket 68 which is adapted to engage and travel in rack 60. Thus, through the central positioning of the drive means on blade assembly 28—and the locating of the rails 26 on the side walls 19 midway between the top wall 14 and bed 16—a balance of thrust is created which is possible throughout the entire length of the cargo container. Heretofore, this has not been possible when hydraulic cylinders or cables have been employed along the bed of the container.

In order to allow for the full longitudinal travel of the blade assembly, there is provided a means to allow the hydraulic pressure lines to adjust to the various lengths required.

As seen in FIG. 2, swing arms 70 are installed between the back of the pusher blade 24 and the front wall 18 of the container. One arm is pivoted to the container at 72, and the other arm is pivoted to the blade assembly 28, indicated at 74 in FIG. 4. Each arm 70 is spring-biased to aid in establishing a folded and closed position, a spring 75 being illustrated in FIG. 4.

Figure 7:
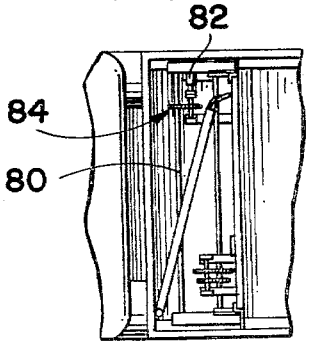
FIG. 7 is a top view of an alternative form of packer blade drive mechanism.

In FIG. 7 there is shown an alternative embodiment wherein guide sprockets 68 are provided with a transverse shaft 80 connecting each guide sprocket, so as to be driven by a second motor 82, and a sprocket-and-chain-drive assembly 84. This arrangement will allow additional forces to be applied to the blade assembly and the load of waste material.

When the apparatus is employed with a totally enclosed container as a rear-loaded and compactor vehicle, there would be included in the hydraulic system an override-release means, indicated at 85. The override-release means would be used when the container is loaded from the rear. That is, the pusher-blade assembly would be positioned adjacent the rear opening, at which time the refuse is packed through the open end into container 12 against blade 24. The above-mentioned override-release means is adjusted so that, as more and more refuse is forced into the container against blade 24, the blade will yield—allowing the refuse to fill the container as a compact load.

Hence, it can be understood that the continuous packing of refuse against the yielding resistance of blade 24 provides for a more efficent compaction and establishes a greater load volume of refuse within a given container.

To unload, the override-release means is closed and the blade can extrude all the waste out of the opening.

If the cargo container is of the overhead or front loader type, the blade assembly will be used to compact the waste material rearwardly as the waste or refuse is loaded within the container.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A refuse-extruder-and-compactor apparatus adapted to be located with a waste-material-storage container having at least two opposing side walls, a bottom wall, and an open discharge end, the apparatus comprising:

a pusher-blade assembly including a pusher blade vertically positioned for linear reciprocal movement within said container;

a track means defined by oppositely positioned rail members mounted to said side walls for movably supporting said blade assembly, each rail member being positioned longitudinally along the mid-section of said side walls, whereby said blade assembly is evenly balanced therebetween in vertical relation to said bottom wall of said container;

means for moving said blade assembly in a linear reciprocal manner along said track means, said means being supported and mounted to said blade assembly wherein said means for moving said blade assembly comprises:

a motor means mounted intermediate the upper and lower ends of said blade assembly;

a drive assembly operably connected to said motor means; and a rack-and-pinion assembly attached adjacent said track means, whereby said drive assembly is adapted to operate said pinion to provide rectilinear motion to said blade assembly; and a guide means provided between said blade assembly and said track means thereof and comprising:

a pair of guide-arm members secured to said blade assembly and extending rearwardly of said blade, and adapted to be slidably supported by respective rail members; and a guide sprocket attached to said guide-arm members and positioned for engagement with said rack rearwardly of said respective pinions, said rack being affixed to said rail along the full length thereof.

2. An apparatus as recited in claim 1, wherein said drive assembly comprises:

a plurality of drive sprockets; and a plurality of drive shafts on which selective drive sprockets are affixed thereto and wherein one of said shafts is transversely positioned between said rails, said pinions being mounted at the opposite ends of said transverse shaft whereby a drive force is equally applied to said blade assembly.

3. An apparatus as recited in claim 2, wherein said motor means comprises a hydraulic motor having inlet and outlet lines attached thereto.

4. An apparatus as recited in claim 3, wherein said apparatus includes means for retracting and extending said inlet and outlet lines as the assembly blade reciprocally moves within said container.

* * * * *